US011112182B2

(12) United States Patent
Euler-Rolle

(10) Patent No.: US 11,112,182 B2
(45) Date of Patent: Sep. 7, 2021

(54) HEAT EXCHANGER WITH ADJUSTABLE GUIDING ELEMENTS BETWEEN TUBES

(71) Applicant: Thomas Euler-Rolle, Vienna (AT)

(72) Inventor: Thomas Euler-Rolle, Vienna (AT)

( * ) Notice: Subject to any disclaimer, the term of this patent is extended or adjusted under 35 U.S.C. 154(b) by 123 days.

(21) Appl. No.: 16/337,945

(22) PCT Filed: Oct. 6, 2017

(86) PCT No.: PCT/AT2017/060252
§ 371 (c)(1),
(2) Date: Mar. 29, 2019

(87) PCT Pub. No.: WO2018/064696
PCT Pub. Date: Apr. 12, 2018

(65) Prior Publication Data

US 2020/0025450 A1 Jan. 23, 2020

(30) Foreign Application Priority Data

Oct. 7, 2016 (AT) ..... A 50911/2016

(51) Int. Cl.
*F28D 1/00* (2006.01)
*F28D 1/053* (2006.01)
(Continued)

(52) U.S. Cl.
CPC ..... *F28D 1/05333* (2013.01); *F28F 1/22* (2013.01); *F28F 1/32* (2013.01); *F28F 1/40* (2013.01);
(Continued)

(58) Field of Classification Search
CPC ..... F28D 1/05333; F28D 1/05341; F28D 2001/0273; F28F 1/22; F28F 1/32;
(Continued)

(56) References Cited

U.S. PATENT DOCUMENTS 1,125,113 A * 1/1915 Junkers ..... F28F 1/22 165/171
2,720,383 A * 10/1955 Huet ..... F28F 1/34 165/177

(Continued)

FOREIGN PATENT DOCUMENTS

DE 2903079 A1 8/1979
GB 2146422 A 4/1985

(Continued)

OTHER PUBLICATIONS

Office Action received in corresponding Austrian Patent Application No. A 50911/2016 dated May 8, 2017 (3 pages).

(Continued)

*Primary Examiner* — Travis C Ruby
(74) *Attorney, Agent, or Firm* — Kilyk & Bowersox, P.L.L.C.

(57) ABSTRACT

A heat exchanger, in particular an oil-air cooler, for heat exchange between a first fluid and a second fluid, having at least a first row and a second row of tubular elements for the first fluid, a flow channel for the second fluid between the first and second rows of tubular elements; a collection vessel at one end of the tubular elements; and a distribution vessel at the other end of the tubular elements. Guiding elements for guiding the second fluid extend along the flow channel between the outer sides of adjacent tubular elements of the first and second rows of tubular elements. At least one adjustment device is provided for adjusting the relative position of two guiding elements about a pivot axis.

21 Claims, 10 Drawing Sheets

(51) Int. Cl.
*F28F 1/22* (2006.01)
*F28F 1/32* (2006.01)
*F28F 1/40* (2006.01)
*F28F 9/16* (2006.01)
*F28F 9/26* (2006.01)

(52) U.S. Cl.
CPC ..... *F28F 9/167* (2013.01); *F28F 9/26* (2013.01); *F28F 2210/10* (2013.01)

(58) Field of Classification Search
CPC ..... F28F 1/40; F28F 1/16; F28F 9/167; F28F 2210/10; F28F 2215/14
See application file for complete search history.

(56) References Cited

U.S. PATENT DOCUMENTS 2,732,615 A * 1/1956 Sandberg ..... B21D 53/08 29/890.038
2,736,406 A * 2/1956 Johnson ..... E04B 9/0478 52/761
2,963,882 A * 12/1960 Malkoff ..... F25D 21/14 62/276
3,262,494 A * 7/1966 Smith, Jr. ..... F28D 1/0477 165/104.31
3,384,167 A * 5/1968 Javkin ..... F28D 1/06 165/171
3,648,768 A 3/1972 Scholl
4,083,093 A 4/1978 Chertok
4,114,598 A * 9/1978 Van Leeuwen ..... F24S 80/30 126/660
4,131,110 A * 12/1978 Jones, Jr. ..... F24S 80/30 126/624
4,158,908 A * 6/1979 Block ..... B21D 53/08 29/890.033
4,241,727 A * 12/1980 Toti ..... F28F 1/22 126/659
4,296,539 A 10/1981 Asami
4,313,430 A * 2/1982 Britner ..... F24S 10/753 126/659
4,336,793 A * 6/1982 Ahearn ..... F24S 10/753 126/621
4,369,836 A * 1/1983 Bleckmann ..... F28F 1/22 165/171
4,589,512 A * 5/1986 Yamaguchi ..... F28D 1/0471 165/41
4,679,617 A * 7/1987 Keldmann ..... F24F 5/0092 165/56
4,694,898 A * 9/1987 Clausen ..... B21C 23/10 165/171
5,174,371 A * 12/1992 Grillo ..... F28F 1/22 165/171
5,411,079 A * 5/1995 Sasaki ..... F28D 1/0246 165/151
5,494,099 A * 2/1996 Chiba ..... F28D 1/05341 165/148
5,647,433 A * 7/1997 Sasaki ..... F28D 1/0246 165/148
5,797,451 A * 8/1998 Grant ..... F25B 39/04 165/171
5,857,515 A * 1/1999 Skupien ..... F28F 21/062 165/47
5,947,195 A * 9/1999 Sasaki ..... B60H 1/00328 165/124
6,364,008 B1 * 4/2002 Mannoni ..... F28D 1/05333 165/171
6,742,576 B2 * 6/2004 Bergevin ..... F28F 1/22 138/143
6,997,248 B2 * 2/2006 Shabtay ..... F28D 1/05333 165/153
8,261,567 B2 * 9/2012 Zangari ..... F28F 1/16 62/255
9,227,353 B2 * 1/2016 Williams ..... B29C 48/0011
9,593,647 B2 * 3/2017 Demots ..... F28D 7/0041
2001/0032718 A1 * 10/2001 Sheerin ..... F28F 1/18 165/130
2003/0070752 A1 * 4/2003 Bergevin ..... F28F 21/062 156/297
2003/0094264 A1 * 5/2003 Bergevin ..... F28F 21/062 165/133
2004/0108105 A1 6/2004 Dwyer
2004/0256093 A1 12/2004 Romero Beltran
2006/0108109 A1 * 5/2006 Romero-Beltran ... F28D 1/0477 165/171
2006/0237172 A1 * 10/2006 Lo ..... F28D 1/024 165/125
2006/0237178 A1 10/2006 Katoh et al.
2008/0000617 A1 1/2008 Cortina-Cordero
2008/0175769 A1 * 7/2008 Goller ..... C10J 3/76 422/201
2010/0200203 A1 * 8/2010 Postma ..... F28F 1/16 165/177
2011/0036553 A1 * 2/2011 Christen ..... F28F 19/006 165/185
2011/0277959 A1 * 11/2011 Morin ..... B23P 15/26 165/104.11
2012/0039762 A1 * 2/2012 Rizzi ..... B01J 8/0285 422/200
2012/0111200 A1 * 5/2012 Gauthier ..... F28F 1/22 95/289
2013/0056190 A1 * 3/2013 Bromberg ..... F28F 3/14 165/173
2014/0027098 A1 * 1/2014 Alahyari ..... F28F 1/00 165/172
2014/0231056 A1 * 8/2014 Covington ..... B23P 15/26 165/168
2014/0284038 A1 * 9/2014 Vedula ..... B22F 10/00 165/185
2015/0053379 A1 * 2/2015 Kirchner ..... F28F 9/001 165/157

FOREIGN PATENT DOCUMENTS

NL 7005449 A 11/1970
WO 03001135 A1 1/2003
WO 2012142070 A1 10/2012

OTHER PUBLICATIONS

International Search Report and Written Opinion issued in corresponding International Patent Application No. PCT/AT2017/060252 (with English translation of International Search Report) dated Dec. 5, 2017 (12 pages).

* cited by examiner

HEAT EXCHANGER WITH ADJUSTABLE GUIDING ELEMENTS BETWEEN TUBES

This application is a National Stage Application of PCT/AT2017/060252, filed Oct. 6, 2017, which claims priority to Austrian Patent Application No. A 50911/2016, filed Oct. 7, 2016.

The invention relates to a heat exchanger, in particular an oil-air-cooler, for heat exchange between a first fluid and a second fluid, having at least a first row of tubular elements and a second row of tubular elements, each for passage of the first fluid, wherein a flow channel is formed for the second fluid between the first and the second row of tubular elements, with a collection vessel at the one ends of the tubular elements and a distribution vessel at the other ends of the tubular elements, wherein guiding elements for guiding the second fluid along the flow channel extend between the outer sides of adjacent tubular elements of the first and second row of tubular elements, the guiding elements each comprise a plate part the wall thickness of which is less than the maximum cross-sectional dimension of the tubular elements connected to the plate part.

Heat exchangers of this kind are known from the state of the art. Generally speaking it is desirable to achieve as efficient a heat transfer as possible from a first fluid to a second fluid for generally small dimensions of the heat exchanger.

The US 2004/0108105 A1 describes a fluid-gas-heat exchanger e.g. a liquid-air-heat exchanger with a number of plate bodies, which comprise tubular elements and guiding elements. A flow channel is formed with deflections relative to its main extension direction between adjacent plate bodies, wherein the guiding elements comprise a sinusoidal profile. The distance between adjacent plate bodies is sometimes smaller than the outer diameter of the tubular elements, which in cross-section may be circularly shaped, wherefore the tubular elements in adjacent plate bodies are arranged offset to one another. The tubular elements are connected to a distribution vessel and to a collection vessel.

The WO 2012/142070 A1 discloses a fluid-air-heat exchanger with plate bodies which comprise tubular elements e.g. circular in cross-section and guiding elements integrally connected therewith. Adjacent tubular elements may be arranged offset to one another. The guiding elements may have an undulating course.

Further heat exchangers with integrally formed plate bodies, which comprise tubular elements and guiding elements connected thereto are known from the NL 7005449 and the US 2006/0237178 A1.

The EP 1 411 314 A1 discloses a heat exchanger with tubular elements which are connected to planar or undulating plates by means of mechanical fasteners. The plates moreover comprise connecting means for mutual connection.

With these known heat exchangers the disadvantage consists in that they are either rigidly constructed from integrally formed plate bodies or in that the tubular elements of the plate bodies are rigidly connected to guiding elements of the plate bodies. The shape of the flow channel is thus permanently fixed.

It is therefore the objective of the invention to alleviate or remove at least individual disadvantages of the state of the art. One aim of the invention may therefore be to propose a heat exchanger of the kind mentioned in the beginning, which can be produced in a simple and low-cost manner with differently configured flow channels. In this context one aim may be to improve the exchange of heat between the first fluid and the second fluid. Furthermore it may be desirable to produce different sizes of the heat exchanger in a simple manner.

To this end the invention provides a heat exchanger as defined in claim 1. Advantageous embodiments and further developments are cited in the dependent claims.

According to the invention it is provided that at least one adjustment device for adjustment of the relative position of two guiding elements about a pivot axis substantially extending in direction of the longitudinal axes of the tubular elements is provided. The heat exchanger, which may be a liquid-air cooler, in particular an oil-air cooler, thus comprises tubular elements arranged in at least two rows through which a first fluid, in particular a liquid, preferably oil, flows. In order to guide the first fluid into the tubular elements, first ends of the tubular elements are connected to a distribution vessel, whilst the first fluid exiting from the opposite second ends of the tubular elements is introduced into a collection vessel at the second ends of the tubular elements. A flow channel for the second fluid, preferably air, is formed respectively between at least two adjacent rows or groups of tubular elements, i.e. between at least a first row or group and a second row or group of tubular elements. If the heat exchanger comprises more than two rows of tubular elements, it is convenient if a flow channel each for the second fluid is formed between all directly adjacent rows of tubular elements. For a simple and low-cost production of the heat exchanger the tubular elements may be substantially circularly shaped in cross-section. Moreover tubular elements circular in cross-section have a favourable effect on the flow conditions in the flow channels adjacent thereto. The tubular elements may therefore be essentially cylindrical in shape. In order to guide the second fluid along the flow channel provided between the first and second row of tubular elements, guiding elements are provided which respectively extend between the outer sides of two adjacent tubular elements of the first/second row of tubular elements. The outer side of the tubular element is formed by the surface of the preferably cylindrical tubular element. In order to be able to design the heat exchanger with as little weight as possible, the guiding elements each comprise a plate part, the wall thickness of which is less than the largest cross-sectional dimension, for example less than the outer diameter of the tubular elements connected thereto. For example the respective plate part is formed as a thin metal sheet with a thickness of 0.2 mm to 1 mm, whilst the inner diameter of the preferably cylindrical tubular elements may be between 0.8 mm and 5 mm. The wall thickness of the tubular elements may for example be between 0.3 mm and 1 mm. Thus, in comparison to the tubular elements, thin low-weight guiding elements extend between adjacent tubular elements. For good heat transfer the plate parts are connected preferably essentially gap-free to the outer sides of the adjacent tubular elements. The flow channel, on one side, is delimited by the tubular elements and the guiding elements formed between them of the first row of tubular elements, and on the other side, by the tubular elements and the guiding elements formed between them of the adjacent second row of tubular elements.

In order to be able to design heat exchangers with differently formed flow channels in a simple and low-cost manner, at least one adjustment device is provided, which serves to adjust the relative spatial position of two guiding elements about a pivot axis essentially extending in direction of the longitudinal axes of the tubular elements. The adjustment device makes it possible, in particular, to form flow channels of varying course with one and the same tubular elements and guiding elements. To this end, it is possible by means of the adjustment device, to adjust the position/the alignment of the guiding elements in relation to the collection vessel or the distribution vessel and thus also the position/the alignment of a guiding element relative to an adjacent guiding element in the first or second row of tubular elements. Thus the adjustment device also makes it possible, using one and the same tubular elements and guiding elements, to form differently shaped heat exchangers. Since there is flexibility in production as regards the shape of the heat exchanger, this can be manufactured in an application-specific manner with a predefined shape of its outer surfaces/circumferential surface. This is advantageous, in particular, if the available installation space for the heat exchanger only allows heat exchangers with a shape deviating from a usual square or rectangular shape. During assembly of the heat exchanger the adjustable guiding elements and the tubular elements connected thereto can be fixed in their respective position/alignment. This is for example done by means of a fixed connection of the tubular elements with the conveniently designed distribution vessel and collection vessel.

According to a preferred embodiment of the invention it may be provided that holding devices, preferably detachable holding devices, in particular plug-in connections, are provided in order to connect adjacent tubular elements of the first or second row of tubular elements with each other via the guiding elements. In this way the heat exchanger can be assembled from individual components according to demand. Because it is possible to connect individual tubular elements and guiding elements with one another by means of the holding devices, the heat exchanger having a number of flow channels can be produced in a modular manner. This represents an essential advantage over heat exchangers of rigidly defined shapes and dimensions. By means of the holding devices in particular, the length of the flow channels can be fixed corresponding to the power requirement of the heat exchanger by connecting a respective number of tubular elements and guiding elements. If the holding devices are designed so as to be detachable, the length or the shape of the flow channel can be altered again after the flow channel has been initially manufactured. Plug-in connections are particularly suitable if the connections are to be quickly made and unmade.

For forming the flow channel by means of individual components it is convenient if two wing parts protrude from the outer side of each tubular element, wherein two wing parts on adjacent tubular elements of the first and second row of tubular elements together form a guiding element for the second fluid. The facing edges of adjacent wing parts may contact each other when the flow channel is assembled (i.e. in an assembled state). The wing parts are preferably integrally formed with the tubular elements.

A particularly stable and constructionally simple connection of tubular elements via the wing parts can be achieved if each wing part comprises a connection element of the holding device, which together form a joint of the adjustment device. With this embodiment the connection elements of the holding device are provided on facing end regions of two adjacent wing parts. Since the connection elements on the facing end regions of two adjacent wing parts together also form a joint of the adjustment device, there is then no need for an adjustment device separate from the holding device. Thus according to this embodiment the holding device also is the adjustment device.

The facing connection elements of the holding device may also be particularly advantageously formed as a joint in that spirally bent edges of the wing parts are provided as connection elements. The spirally bent edges are arranged to rotatably engage with each other and can, in order to produce a rotatable connection, be pushed into each other, for example in direction of the longitudinal axes of the tubular elements.

According to a further embodiment of the invention it may be provided that the guiding elements each comprise a joint portion of the adjustment device, which joint portion is rotatably arranged about at least one of the tubular elements connected to the guiding element. Conveniently the joint portion is arranged at the end of the guiding element, the end facing the adjacent tubular element. In this way the tubular element connected to the guiding element forms a second joint portion of the adjustment device, so that the guiding element is rotatable about the tubular element. The joint portion of the guiding element may be permanently or detachably connected to the tubular element. If the joint portion of the guiding element is detachably connected to the tubular element, the joint portion of the guiding element and the tubular element are preferably also connection elements of a detachable holding device, so that there is then no need for an additional detachable holding device in the guiding elements. If, however, the joint portion of the guiding element is permanently connected with the tubular element, a detachable holding device may be conveniently provided in the guiding element.

For a particularly flexible and modular design of the flow channels it may be provided that the holding devices are arranged between the guiding elements and the outer sides of the tubular elements, and the guiding elements between the holding devices comprise the adjustment device with the pivot axis extending in direction of the longitudinal axes of the tubular elements.

To ensure a quick heat transfer between the first and the second fluid it may be provided that the tubular elements of the first and second row of tubular elements and the guiding elements are arranged in relation to each other such that the main extension directions of at least two adjacent guiding elements of the first and second row of tubular elements enclose an angle deviating from 180° in a plane essentially at right angles to the longitudinal axes of the tubular elements. In this way the flow channel for the second fluid between the first and second row of tubular elements may be curved, as a result of which the length of the flow channel is increased and heat transfer between the first and the second fluid is improved. The length of the flow channel is defined by the flow path of the second fluid between the beginning of the flow channel and the end of the flow channel. The main extension direction of a guiding element is the direction from one tubular element connected with the guiding element, in particular from the middle of the one tubular element, to the other tubular element connected to the guiding element, in particular to the middle of the other tubular element.

If the arrangement of the tubular elements of the first and second row of tubular elements and of the at least two adjacent guiding elements in the first or second row of tubular elements which guiding elements enclose the angle deviating from 180° repeats at regular intervals, the flow channel, as regards a virtual connecting line between its beginning and its end, may comprise periodic deflections. With this arrangement the heat exchanger/the rows of tubular elements may be produced from components with partially identical shaping. This makes production of the heat exchanger in different sizes easier.

With one convenient embodiment it may be provided that the arrangement of the tubular elements of the first and second row of tubular elements and of the guiding elements in a plane essentially at right angles to the longitudinal axes of the tubular elements forms an essentially undulating course of the flow channel. In particular the undulating course may be a sinusoidal course. Complete crests and troughs of a wave of the undulating course may respectively extend over a number of guiding elements. The maximum deflection of the undulating flow channel, for example the maximum amplitude of the sinusoidal course, may be smaller, equal to or larger than the distance between adjacent rows of tubular elements.

A flow channel with undulating course may be produced particularly advantageously if the plate parts each comprise outer surfaces which are arched, in particular form a circular-segment arc. For the flow channel to be formed in a sinusoidal manner the arch-like plate parts may be curved, in particular in the form of a portion of a sine curve. A complete crest of a wave or trough of a wave may extend between adjacent tubular elements of a row of tubular elements, followed by a complete trough of a wave or crest of a wave to the next tubular element. Alternatively, complete crests or troughs of a wave of the undulating course may extend respectively across a number of curved plate parts of the guiding elements.

In another convenient embodiment it may be provided that the arrangement of the tubular elements of the first and second row of tubular elements and of the guiding elements in a plane essentially at right angles to the longitudinal axes of the tubular elements forms an essentially zigzag-shaped course of the flow channel. A complete period of the zigzag-shaped course respectively may extend across two or more than two guiding elements/plate parts. The maximum deflection of the zigzag-shaped flow channel may be smaller, equal to or larger than the distance between adjacent rows of tubular elements.

In order to improve the flow conditions in the flow channel it may also be provided that the tubular elements of the first and second row of tubular elements are arranged offset to one another in flow direction of the second fluid. In this way the tubular elements of a row of tubular elements are for example arranged opposite the guiding elements of the adjacent row of tubular elements. The second fluid must then flow along a part of the curved outer sides of the tubular elements, as a result of which the path of the second fluid along the flow channel and thus the time duration for heat transfer are prolonged. The guiding elements or their respective plate part may be shaped in a planar or curved fashion.

In order to improve the heat exchange between the first and second fluid further, it may be provided that at least one guiding element comprises at least one plate body protruding therefrom. The plate body, which protrudes into the flow channel, enlarges the area of the guiding element provided for heat exchange. Conveniently the plate body is arranged on the guiding element/the plate part at an angle thereto different from 90°, in particular at an acute angle to the flow direction of the second fluid. Preferably a number of guiding elements of a row of tubular elements, for example every single guiding element, every second guiding element or generally every n-th guiding element may comprise at least one plate body protruding therefrom.

To promote efficient heat exchange between the first and the second fluid it may be further provided that the main extension directions of at least two adjacent flow channels enclose an angle deviating from 0°. The main extension direction of a flow channel is the direction starting from an entry region of the second fluid into the flow channel, in particular from the middle of the entry region between adjacent rows of tubular elements, to an exit region of the second fluid out of the flow channel, in particular to the middle of the exit region between adjacent rows of tubular elements. In this way a heat exchanger can be produced having a number of flow channels, which widen from their entry to their exit. Thus the distance between the two tubular elements of the rows of tubular elements most remote from each other may be less at the entry of the flow channels than the distance between the two tubular elements of the most remote rows of tubular elements at the exit of the flow channels.

For a compact construction of the heat exchanger which makes it possible to adjust an appropriate shape for the flow channels, it is advantageous if the collection vessel and/or the distribution vessel, viewed in a virtual cutting plane essentially at right angles to the longitudinal axes of the tubular elements, is shaped essentially rectangular, as a circular ring segment or a circular ring. The collection vessel and/or the distribution vessel may not necessarily be shaped exactly rectangular, as a circular ring segment or a circular ring in the sectional view. For example, the corners of the rectangular or circular-ring-segment-shaped collection vessel and/or distribution vessel may be rounded off or their longitudinal sides or broadsides may be curved in a shape deviating from the ideally rectangular or circular-ring-segment shape. A rectangular collection vessel and/or rectangular distribution vessel comprise, at any rate, a longitudinal extension and a broadside extension shorter in comparison thereto.

In a further embodiment the collection vessel and/or the distribution vessel, in a virtual cutting plane essentially at right angles to the longitudinal axes of the tubular elements, may comprise a shape, which is a combination of at least one rectangle and at least one circular segment. For example, the collection vessel and/or the distribution vessel may comprise two rectangular areas in the virtual cutting plane, which areas are connected to each other via a circular-segment-shaped area.

In an alternative embodiment it may be provided that the collection vessel and/or the distribution vessel, in a virtual cutting plane essentially at right angles to the longitudinal axes of the tubular elements, is essentially circular ring-segment-shaped or circular-ring-shaped, wherein the main extension direction of the flow channel extends at an angle deviating from 0°, in particular at an angle between 30° and 60° to the radial direction of the collection vessel and/or to the radial direction of the distribution vessel, which radial direction starts at the beginning or end of the flow channel. In particular the main extension direction of the flow channel may extend at an angle between 40° and 50°, for example at an angle of 45° to the radial direction of the collection vessel and/or to the radial direction of the distribution vessel. The beginning of the flow channel then corresponds to the entry region of the second fluid into the flow channel, and the end of the flow channel corresponds to the exit region of the second fluid out of the flow channel. The oblique arrangement of the flow channel in the heat exchanger lengthens the path of the second fluid through the flow channel.

The invention will now be explained further by way of preferred non-restrictive exemplary embodiments with reference to the drawings, in which FIG. 1A shows an oblique view of a heat exchanger according to the invention with tubular elements for a first fluid and guiding elements arranged in between for a second fluid;

Figure 10:
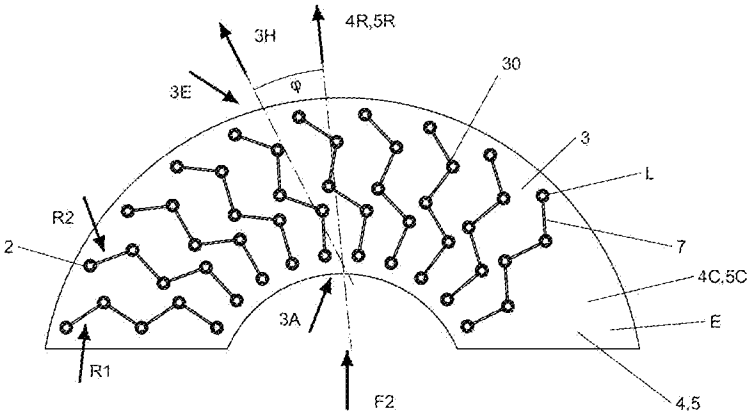
Figure 11B:
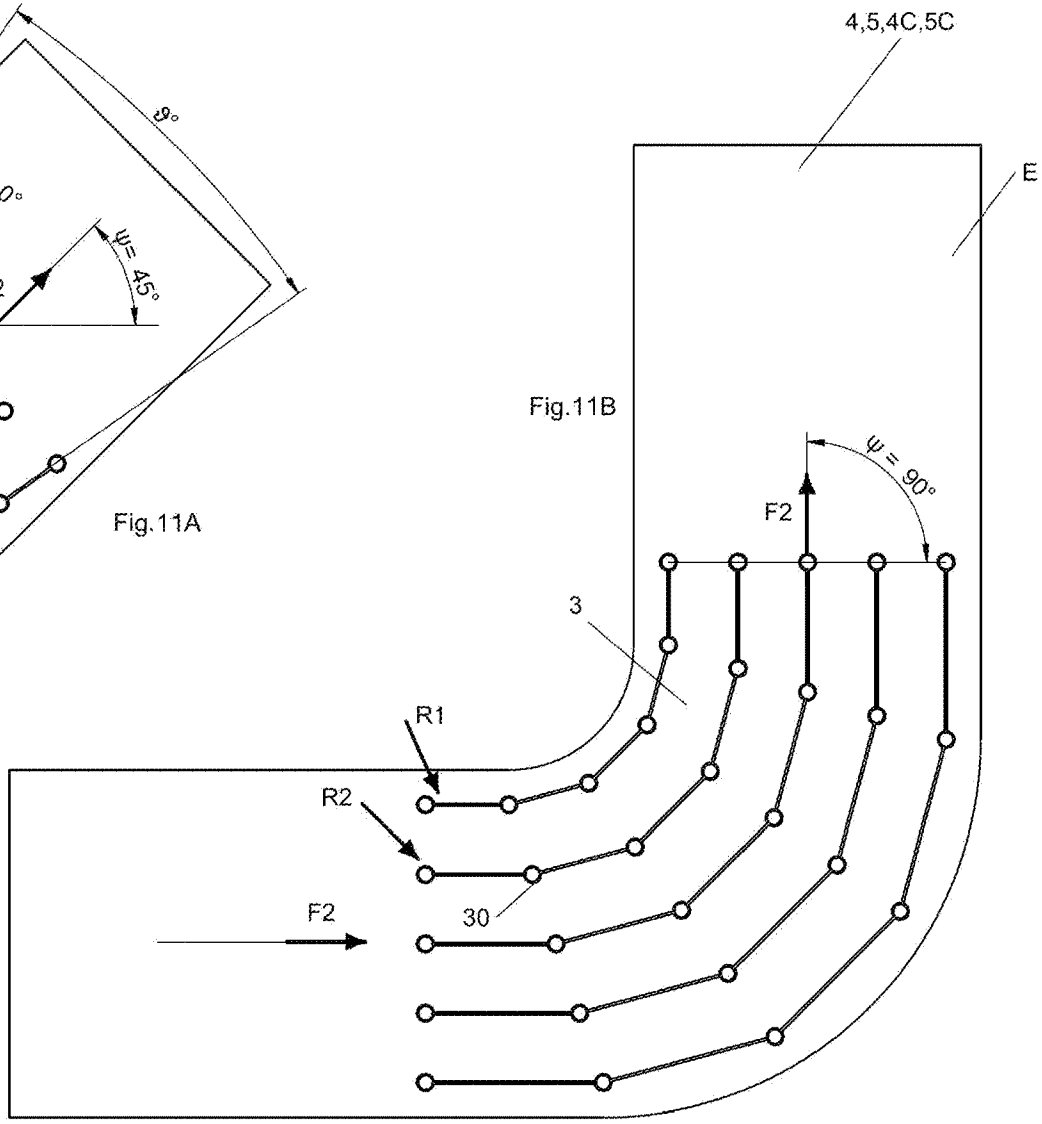
Figure 11A:
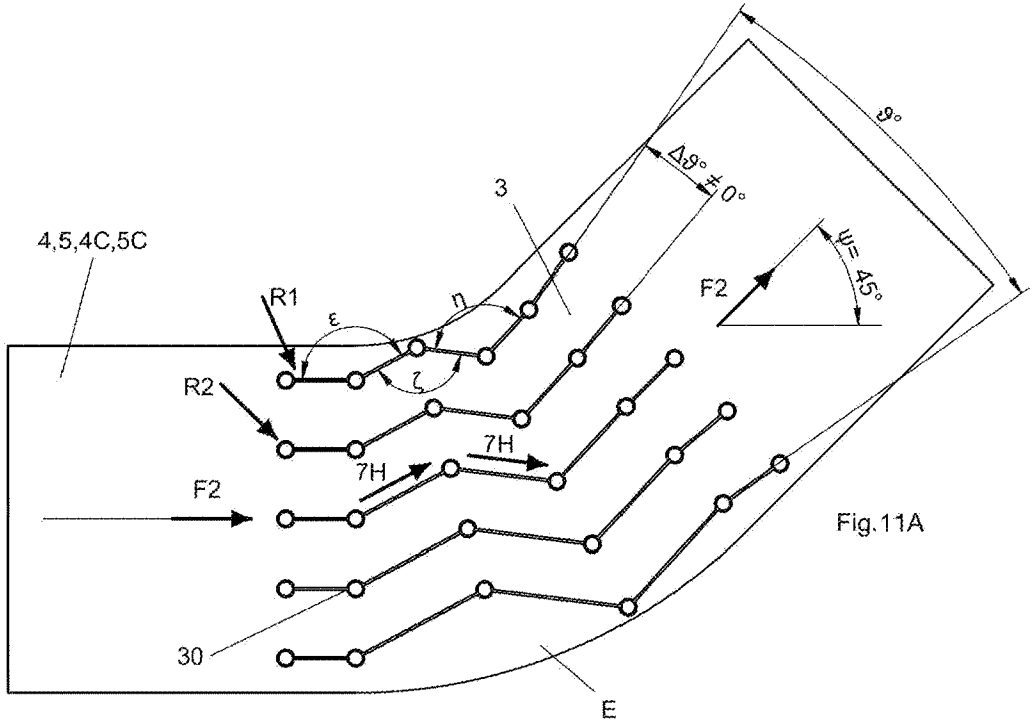

FIG. 10 shows an arrangement of rows of tubular elements in a circular-ring-segment-shaped collection baseplate of collection vessel, wherein the main extension direction of the flow channel extends obliquely to the radial direction of the collection vessel; and FIGS. 11A and 11B show two further embodiments of the collection vessel or of the distribution vessel with tubular elements and guiding elements pivoted against each other.

Figure 1B:
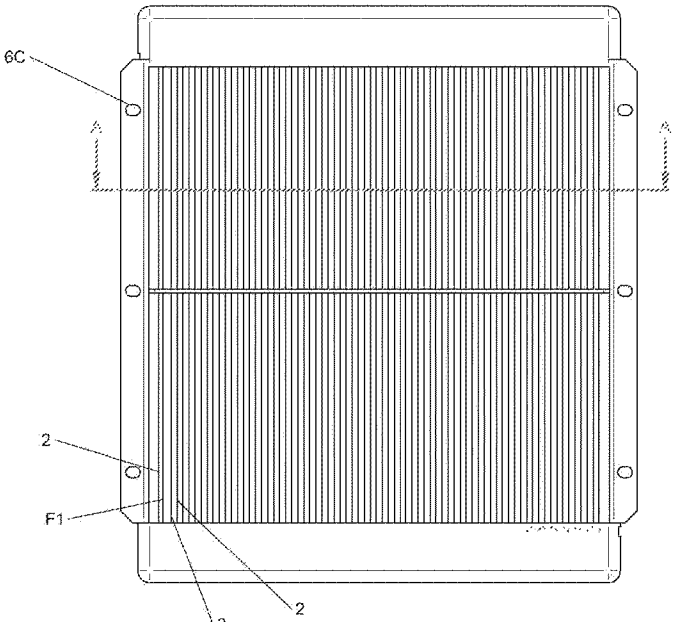
FIG. 1B shows the heat exchanger of FIG. 1A in a view from the front.
Figure 1C:
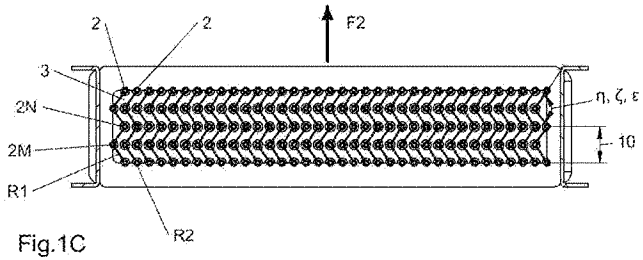
FIG. 1C shows a sectional view through the heat exchanger of FIG. 1B along a cutting line A-A.
Figure 1A:
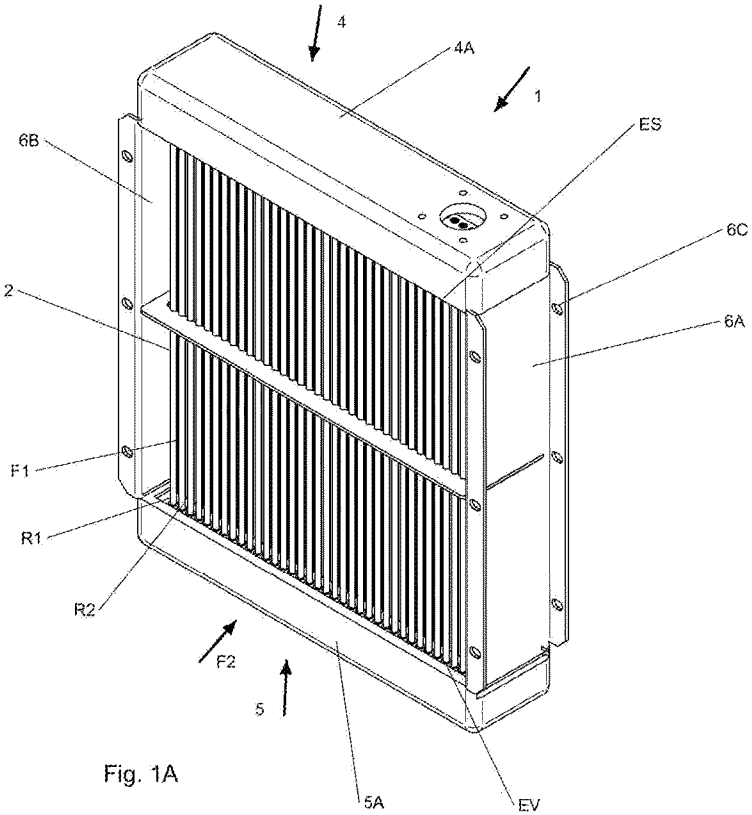
Figure 2:
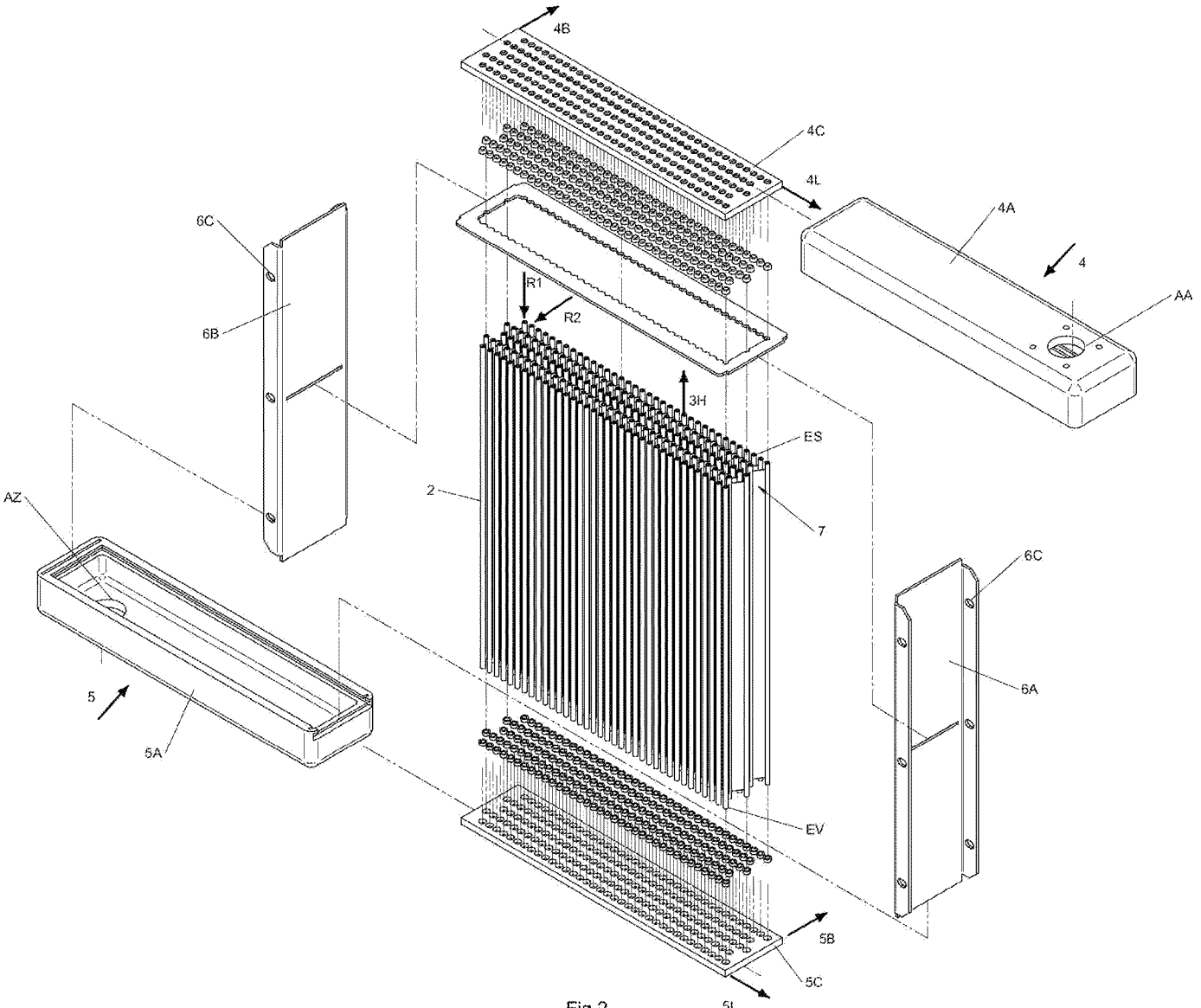
FIG. 2 shows the heat exchanger of FIG. 1A in an exploded view.

FIG. 1A shows a heat exchanger 1 in a view obliquely from above, which in particular may be an oil-air-cooler. The heat exchanger 1 is used for heat exchange between a first fluid F1 and a second fluid F2 and comprises at least a first row R1 of tubular elements 2 and a second row R2 of tubular elements 2. The first fluid F1, for example oil, flows through the tubular elements 2. To facilitate heat exchange, a flow channel 3 for the second fluid F2, for example air, is formed between the first row R1 and the second row R2 of tubular elements 2. The heat exchanger 1 may be used as a liquid-air-cooler for cooling a liquid such as oil as a first fluid F1 by means of the cooling air, as a second fluid F2 or as a liquid-air heating device for the warming of air as the second fluid F2 by means of the warming liquid such as oil as the first fluid F1. The heat exchanger 1 also comprises a collection vessel 4 at the one ends ES of the tubular elements 2 and a distribution vessel 5 at the other ends EV of the tubular elements 2. At a connection point AZ (FIG. 2) the distribution vessel 5 is connected to a feed pipe not shown, through which the first fluid F1 is fed to the distribution vessel 5, which distributes the fed-in first fluid F1 at the ends EV among the tubular elements 2. At the other ends ES of the tubular elements 2 the first fluid F1 again exits from the tubular elements 2 and is directed into the collection vessel 4 connected to the ends ES. The collection vessel 4 is connected at a connection point AA (FIG. 2) to a discharge pipe not shown. The distribution vessel 5 comprises a distribution box 5A and a distribution baseplate 5C received therein. Correspondingly the collection vessel 4 comprises a collection box 4A and a collection baseplate 4C received therein. When the first fluid F1 is a liquid, for example oil, a liquid pump or oil pump not shown may be provided. The second fluid F2, for example air, may be conveyed through the flow channels 3 by means of a fan not shown. The heat exchanger 1 also comprises side parts 6A, 6B with through openings 6C for attaching the heat exchanger 1 to a carrier body not shown. The tubular elements 2 are essentially circular-shaped in cross-section and thus comprise a cylindrical shape. A cross-sectional view of a tubular element 2 is for example depicted in FIG. 3B. The cylindrical tubular elements 2 have a smooth outer surface 2A which is essentially free from indentations and elevations. Ribs 2V are preferably provided in the interior 21 of the cylindrical tubular elements 2. Guiding elements 7 are provided in order to be able to guide the second fluid F2 along the flow channel 3 between the first row R1 and the second row R2 of the tubular elements 2. The guiding elements 7 respectively extend between the outer sides 2A of two adjacent tubular elements 2M, 2N of the first row R1/the second row R2 of tubular elements 2. The rows RN, e.g. R1, R2, of tubular elements 2 thus comprise the tubular elements 2, between which the guiding elements 7 extend. The guiding elements 7 each comprise a plate part 8, the wall thickness 8W of which is less than the largest cross-sectional dimension of the tubular elements 2 connected thereto, i.e. is less, in the case of the cylindrical tubular elements, than the outer diameter 2D of the tubular elements 2 connected thereto, see for example FIG. 4B. The flow channel 3 for the second fluid F2 is thus formed by means of the walls W, which are formed from the outer sides 2A of the tubular elements 2 and the guiding elements 7 arranged between them of a first row R1 of tubular elements 2 and by means of the walls W, which are formed from the outer sides 2A of the tubular elements 2 and the guiding elements 7 arranged between them of a second row R2 of tubular elements 2.

Although in the description reference is made to a flow channel 3 for the second fluid F2, which is formed between the first row R1 and the second row R2 of tubular elements 2, it should be remembered that the heat exchanger 1 can of course comprise more than two rows R1, R2 of tubular elements 2. For example, the heat exchanger 1 can comprise between 10 and 100, for example between 30 and 80 rows RN of tubular elements 2. A flow channel 3 is formed between two adjacent rows R1, R2 of tubular elements 2. A heat exchanger 1 with n rows RN of tubular elements 2 thus comprises n−1 flow channels 3. The features which refer to a flow channel 3 and a first row R1 and a second row R2 of tubular elements 2, therefore also apply to any additional, preferably to all envisaged flow channels 3 and rows RN of tubular elements 2. Preferably at least one further row RX of tubular elements 2 is provided, which in particular is designed corresponding to the first row R1 or the second row R2 of tubular elements 2.

As revealed in the examples depicted in FIGS. 3A to 3E, 4A and 4B, at least one adjustment device 30 is provided for changing the relative position of two guiding elements 7 during assembly of the heat exchanger about a pivot axis 31 extending essentially in direction of the longitudinal axes L of tubular elements 2. By means of the adjustment device 30, the guiding elements 7 connected to the adjustment device 30 can therefore be adjusted, in particular pivoted against each other. Depending on the position of the adjustment device 30 the walls W of adjacent rows RN of tubular elements 2 can extend in parallel to one another or, at least in sections, enclose between them an angle deviating from 0°. The heat exchanger 1 may comprise a single adjustment device 30 or one or more adjustment devices 30 per row RN of tubular elements 2. In particular each combination of one tubular element 2 and a guiding element 7 connected thereto may comprise an adjustment device 30 in order to, in particular, permit high flexibility in designing the flow channels 3.

As moreover revealed in the examples depicted in FIGS. 3A to 3E, 4A and 4B, holding devices 12 are provided in order to connect adjacent tubular elements 2M, 2N of the first or second row R1, R2 of tubular elements 2 with each other via the guiding elements 7. The holding devices 12 are preferably detachable holding devices 12A, in particular plug-in connections 12B. In the examples shown in FIGS. 3A to 3E, 4A and 4B, the holding devices 12 are, at the same time, the adjustment devices 30, i.e. the holding devices 12 also serve to adjust the relative position of two guiding elements 7 about a pivot axis 31 extending essentially in direction of longitudinal axes L of the tubular elements 2. The relative position of two guiding elements 7 may be understood to be the identical or different course of two cutting lines, which are created when the two guiding elements 7 intersect a plane E essentially at right angles to the longitudinal axes L of the tubular elements 2. If two guiding elements 7 comprise different positions, orientation of the guiding elements 7 may be different from one another, wherein the orientation of a guiding element 7 is defined by the virtual connection line between the two end points of the guiding element 7 or between the tubular elements 2 connected thereto. Similarly the orientation of two guiding elements 7 may be the same, but the course of the two guiding elements 7 between their end points may be different if the two guiding elements 7 comprise different positions.

As further revealed in the examples shown in FIGS. 3A to 3E, 4A and 4B, two wing parts 13A, 13B protrude from the outer side 2A of each tubular element 2. Two wing parts 13B, 13C on adjacent tubular elements 2M, 2N of the first or second row R1, R2 of tubular elements together, i.e. preferably in a connected state, form a guiding element 7 for the second fluid F2. In order to be able to connect the wing parts 13A, 13B with each other, each wing part 13A, 13B in the examples shown comprises a connection element 14A, 14B of the holding device 12, 12A, 12B. The connection elements 14A, 14B together form a joint 32 of the adjustment device 30, with which joint 32 the relative position of two guiding elements 7 connected to the joint 32 can be adjusted/with which joint 32 the relative position of the two wing parts 13A, 13B connected to the joint 32 and which together form a guiding element 7, can be adjusted. The joint 32 is thus arranged in the guiding element 7. The connection elements 14A, 14B in the depicted examples are configured as spiral-shaped curved edges of the wing parts 13A, 13B, the edges being configured for mutually rotatably engaging with each other. Conveniently the spiral-shaped curved edges are configured to be pushed into each other in order to form a plug-in connection 12B.

Figure 3B:
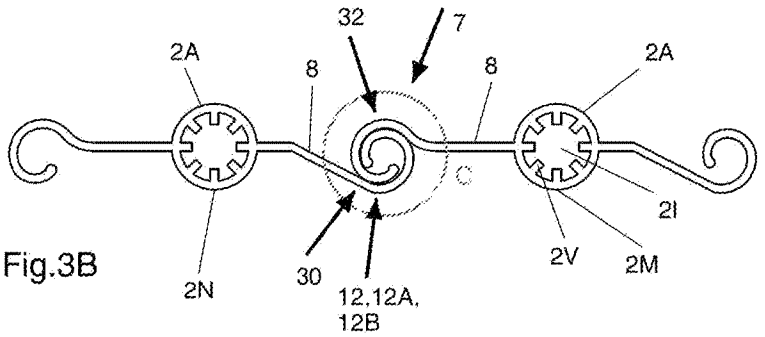
FIGS. 3A to 3D show an embodiment of an adjustment device and a holding device for the heat exchanger as per FIGS. 1A to 1C and FIG. 2 in an oblique view (FIG. 3A), a detail view from above (FIG. 3B), a detail view of the holding device (FIG. 3C) and a detail view of a tubular element (FIG. 3D)
Figure 3C:
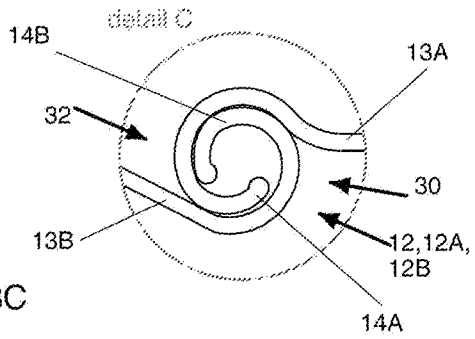
Figure 3D:
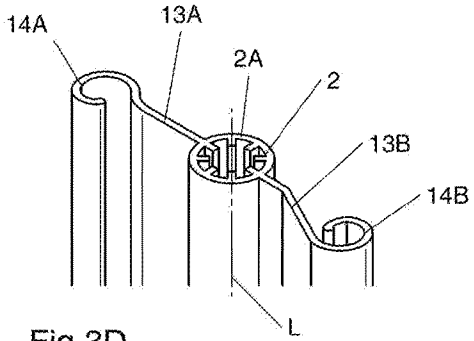
Figure 3A:
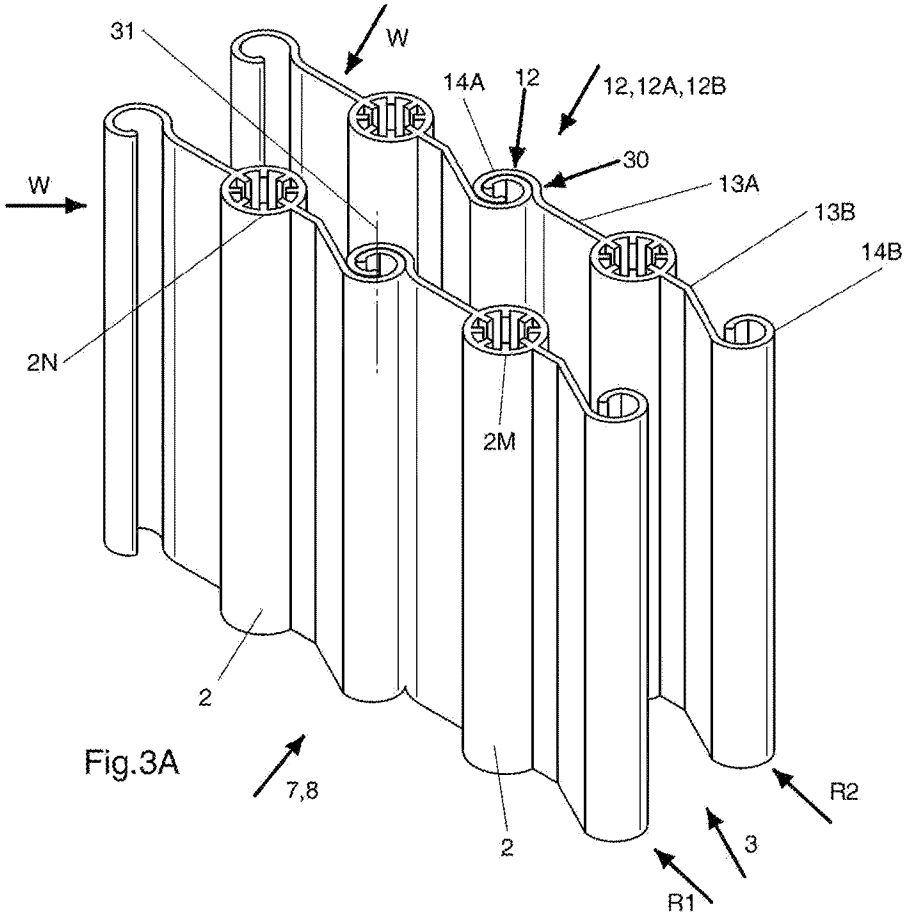
Figure 3E:
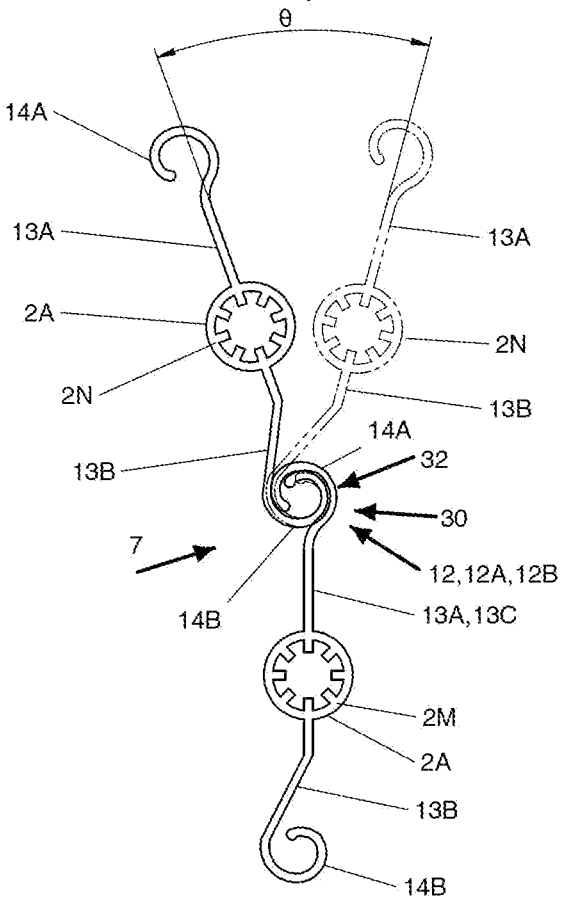
FIG. 3E shows an arrangement of tubular elements and guiding elements for the heat exchanger as per FIGS. 1A to 1C and FIG. 2, in which the main extension directions of two adjacent guiding elements of a same row of tubular elements are pivoted against each other.

In FIGS. 3A and 3B a combination of tubular elements 2 and guiding elements 7 is shown, in which the guiding elements 7 or the wing parts 13A, 13B which together form a guiding element 7 enclose an angle of 180°, i.e. essentially point in the same direction. In this way a flow channel 3 with parallel walls W can be created. FIG. 3E by comparison shows a combination of tubular elements 2 and wing parts 13A, 13B, in which the wing parts 13A, 13B of different tubular elements 2 together enclose an angle deviating from 180°, i.e. essentially point in different directions. In addition, in FIG. 3E, dotted lines indicate a position of a tubular element 2 and of wing parts 13A, 13B connected therewith adjusted by an angle θ by means of the adjustment device 30.

Figure 4B:
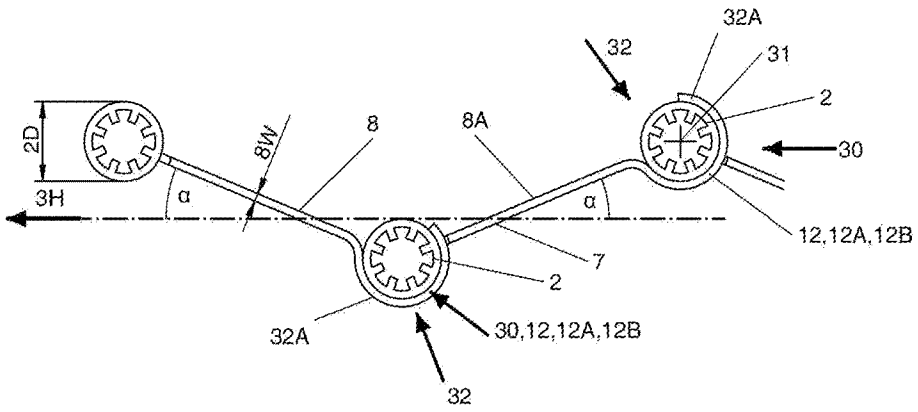
FIGS. 4A and 4B show a further embodiment of an adjustment device and a holding device for the heat exchanger as per FIGS. 1A to 1C and FIG. 2 in an oblique view (FIG. 4A) and in a view from above (FIG. 4B)
Figure 4A:
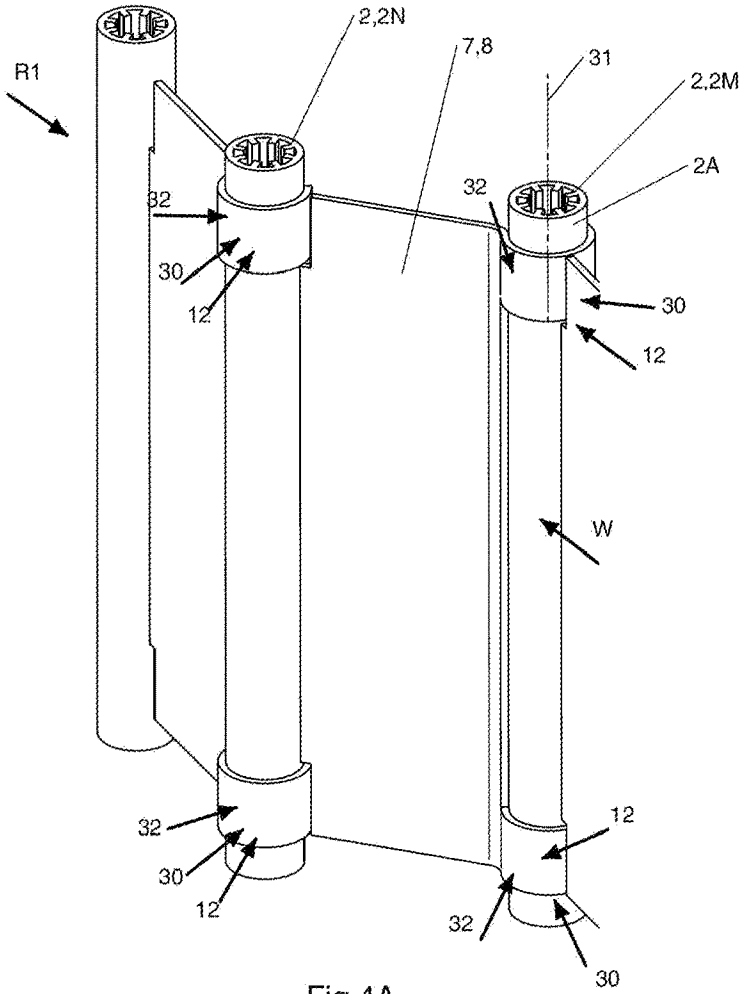

FIGS. 4A and 4B show another embodiment of the adjustment device 30, which is simultaneously formed as a holding device 12. Here the guiding elements 7 each comprise a joint portion 32A of the adjustment device 30, which joint portion 32A is rotatably arranged about at least one of the tubular elements 2 connected to the guiding element 7. The tubular element 2 serves as a second joint portion, which together with the joint portion 32A of the guiding element 7 forms a joint 32. The guiding element 7 can thus be rotated/pivoted about the tubular element 2 which engages the joint portion 32A of the guiding element 7. The joint portion 32A of the adjustment device 30 for example may be configured as a clamp which can be snapped onto a tubular element 2. FIG. 4B clearly shows that the guiding elements 7, by means of the adjustment device 30, enclose an angle deviating from 180°/can be pivoted about an angle α relative to a main extension direction 3H of the flow channel 3.

Among others, in FIGS. 1C, 5, 6, 9A and 9B an arrangement of tubular elements 2 of the first and second rows R1, R2 of tubular elements 2 and of guiding elements 7 is recognisable, in which the main extension directions 7H of at least two adjacent guiding elements 7 of the first and second rows R1, R2 of tubular elements 2, in a plane E essentially at right angles to the longitudinal axes L of the tubular elements 2, enclose an angle η, ζ, ε deviating from 180°. The angles η, ζ, ε between the main extension directions 7H of respectively two adjacent guiding elements 7 may, by means of the adjustment device 30, be set to different sizes, as for example shown in FIG. 5. FIG. 1C by comparison, shows an embodiment, in which the angles η, ζ, ε deviating from 180° between the main extension directions 7H of respectively two adjacent guiding elements 7 are of identical size. FIG. 1C indicates that the arrangement of tubular elements 2 of the first or second rows R1, R2 of tubular elements 2 and of the at least two adjacent guiding elements 7 in the first or second row R1, R2 of tubular elements 2, which guiding elements 7 enclose the angle η deviating from 180°, repeats at regular intervals 10.

Figure 6:
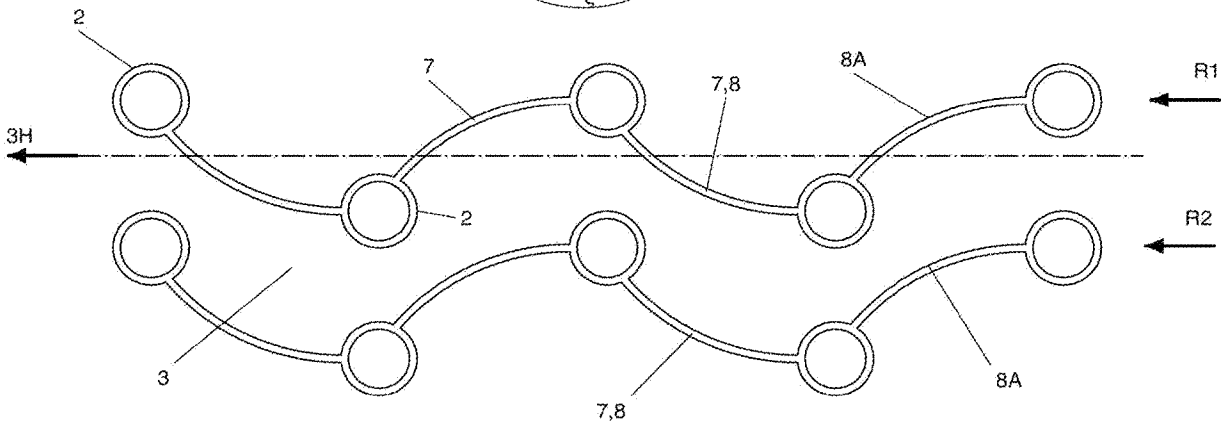
FIG. 6 shows an arrangement of tubular elements and guiding elements for the heat exchanger as per FIGS. 1A to 1C and FIG. 2, in which the flow channel has an undulating course.

FIG. 6 shows an embodiment of a flow channel 3 having a substantially undulating course, viewed in a plane E essentially at right angles to the longitudinal axes L of the tubular the elements 2, which is formed by a corresponding arrangement of tubular elements 2 of the first or second row R1, R2 of tubular elements 2 and of the guiding elements 7. The plate parts 8 of the guiding elements 7 in this example respectively comprise arched, in particular circularly arched outer surfaces 8A.

For clarity's sake the adjustment device 30 and the holding device 12 are not shown in FIG. 6. Here as well, the adjustment device 30 and the holding device 12 may be configured as a joint assembly, i.e. may be identical, or one of the adjustment device 30 and the holding device 12 may be provided in the guiding element 7 and the other of the adjustment device 30 and the holding device 12 may be provided at the connection point of the guiding element 7 and the tubular element 2.

Figure 9B:
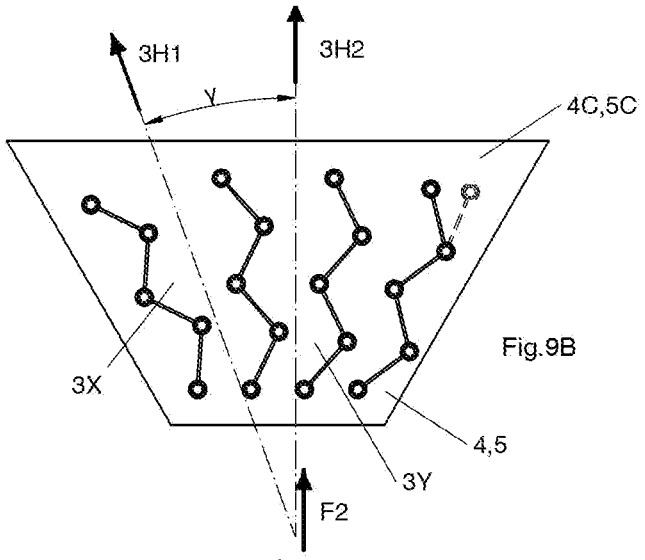
FIGS. 9A and 9B show two embodiments of a heat exchanger, in which the main extension directions of respectively two adjacent flow channels enclose an angle deviating from 0°.
Figure 9A:
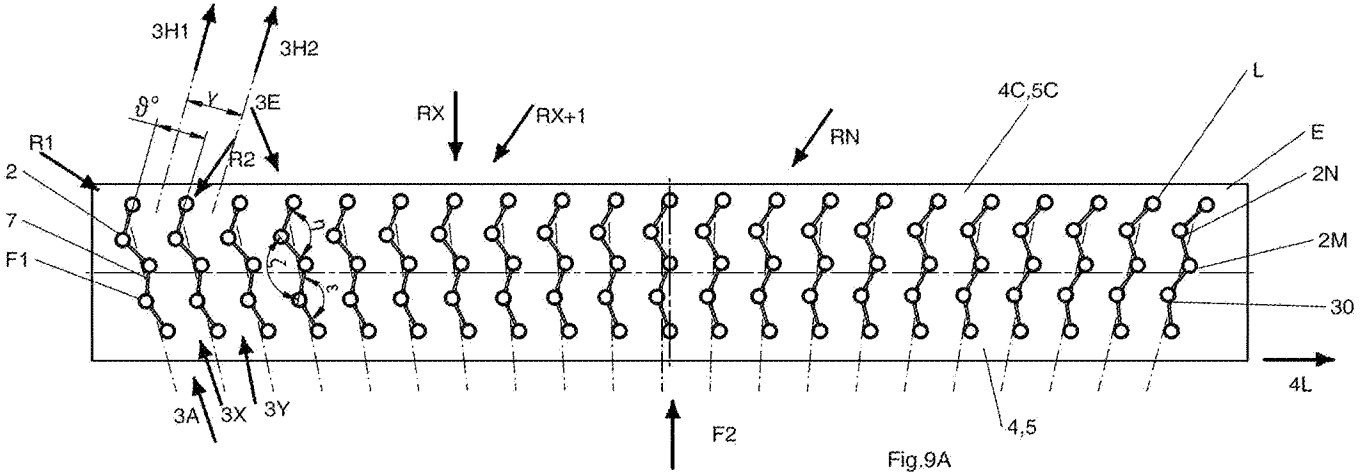
Figure 5:
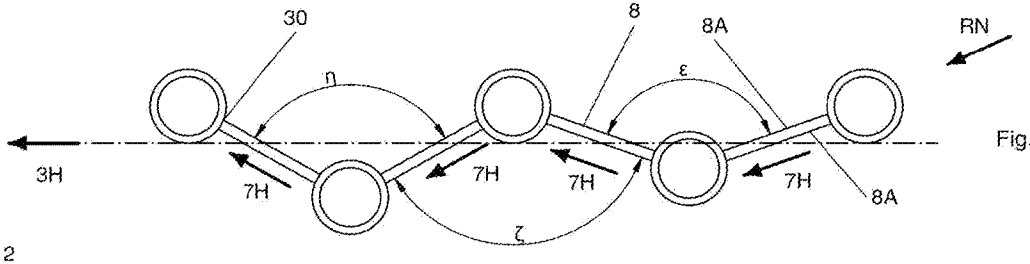
FIG. 5 shows an arrangement of tubular elements and guiding elements for the heat exchanger as per FIGS. 1A to 1C and FIG. 2, in which the main extension directions of two adjacent guiding elements of a same row of tubular elements are pivoted against each other.

Among others, FIGS. 1C, 9A and 9B show an embodiment of a flow channel 3 having an essentially zigzag-shaped course, viewed in a plane E essentially at right angles to the longitudinal axes L of the tubular elements 2, which is formed by a corresponding arrangement of the tubular elements 2 of the first and second row R1, R2 of tubular elements 2 and of the guiding elements 7, by means of the adjustment device 30.

Figure 7:
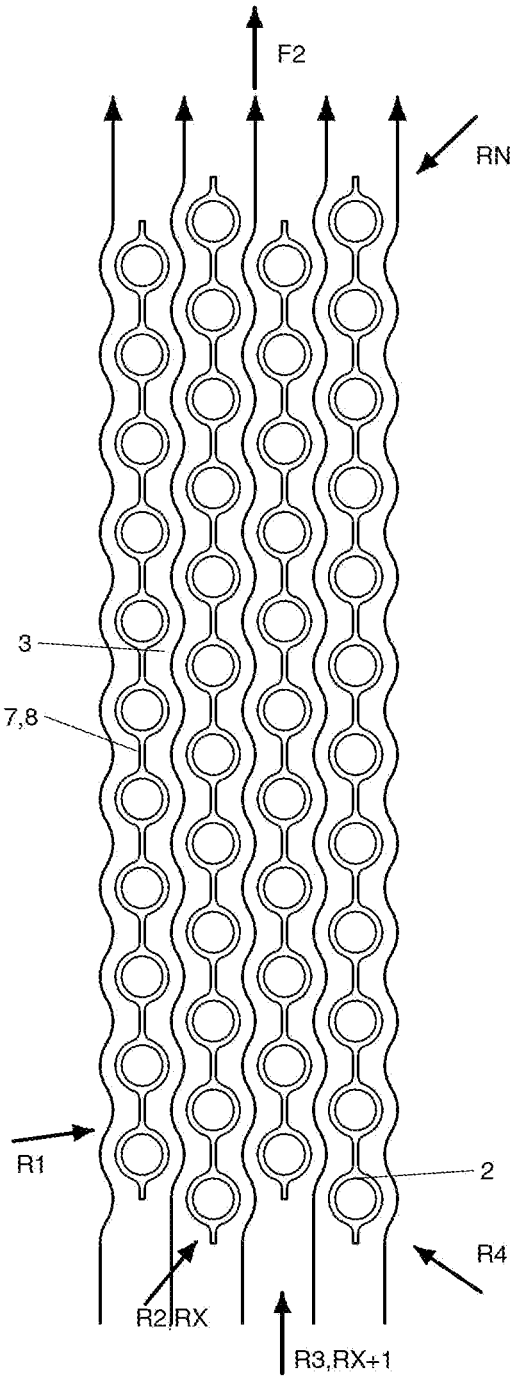
FIG. 7 shows a further arrangement of rows of tubular elements, which in this embodiment are arranged offset against each other in the main extension direction of the flow channel.

FIG. 7 shows an embodiment of a flow channel 3, in which the tubular elements 2 of the first and second rows R1, R2 of tubular elements 2 are arranged offset to one another in flow direction of the second fluid F2. The tubular elements 2 of a row RX are arranged opposite the guiding elements 7 or plate parts 8 of an adjacent row RX+1.

Figure 8A:
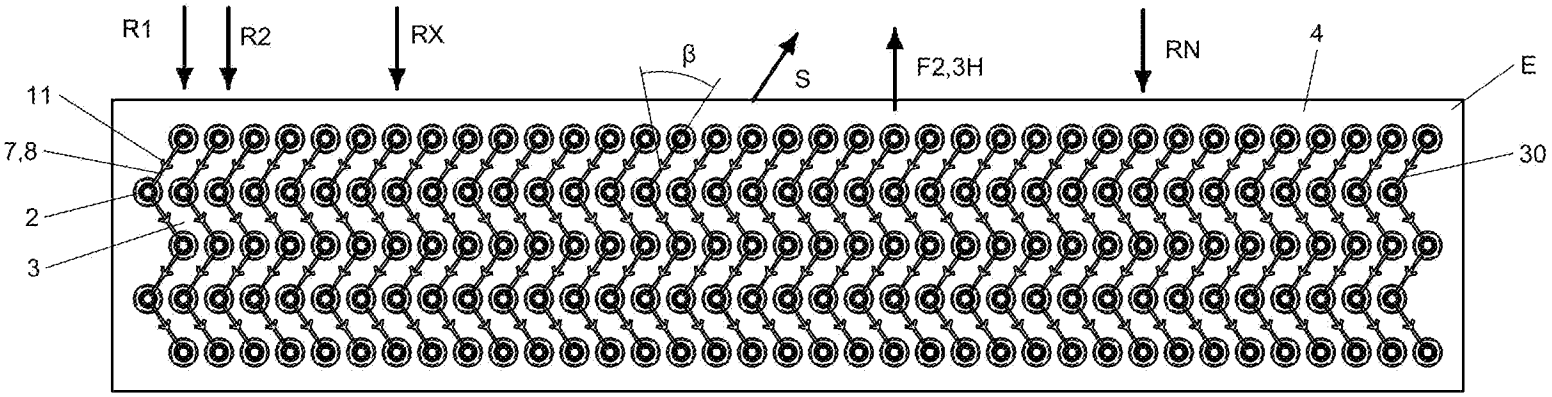
FIG. 8A shows a further arrangement of rows of tubular elements with plate bodies protruding from the guiding elements, in a view from above.
Figure 8B:
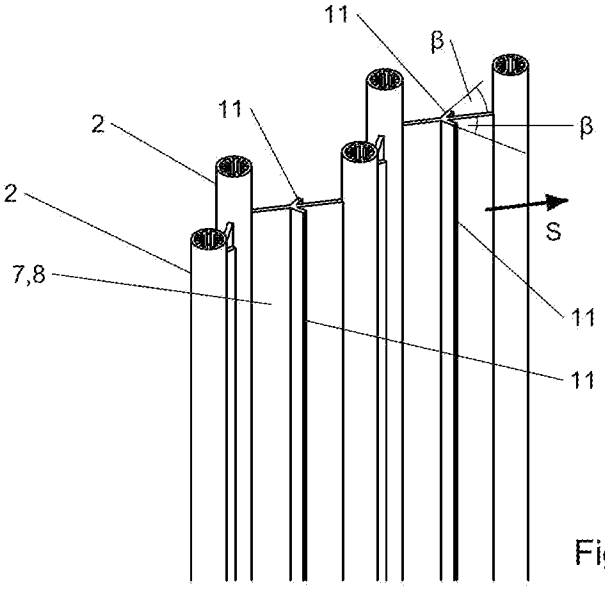
FIG. 8B shows a detailed oblique view of a section of a row of tubular elements with plate bodies protruding from the guiding elements.

In FIGS. 8A and 8B it can be clearly recognised that at least one guiding element 7, preferably a number of or all guiding elements 7, comprises/comprise at least one plate body 11 protruding therefrom. The plate body 11 protrudes into the flow channel 3 and thereby enlarges the area of the guiding element 7. The plate body 11 is arranged at the guiding element 7/the plate part 8 at an angle β different from 90°, in particular in flow direction S of the second fluid F2, at an acute angle β of between 30 and 60 degrees, for example, to the guiding element 7/the plate part 8. Here as well, at least one adjustment device 30 (not shown) may be provided.

FIG. 9A shows a collection vessel 4 and its collection base plate 4C or a distribution vessel 5 and its distribution baseplate 5C, which are essentially rectangular, when viewed in a virtual cutting plane E essentially at right angles to the longitudinal axes L of the tubular elements 2. In particular the main extension directions 3H1, 3H2 of at least two adjacent flow channels 3X, 3Y enclose an angle γ deviating from 0°. In order to adjust the different main extension directions 3H1, 3H2 of the flow channels 3X, 3Y, the angles η, ζ, ε between the main extension directions 7H of respectively two adjacent guiding elements 7 of a row RN of tubular elements 2 may be chosen to be of different sizes. For example the flow channels 3, which enclose an angle γ deviating from 0°, may widen from their inlet or beginning 3A towards their outlet or end 3E. In the example shown in FIG. 9A the two guiding elements 7 of rows R1 and R2, which guiding elements 7 are next to the end 3E of the flow channel 3 enclose an angle δ deviating from 0°.

FIG. 9B shows a collection vessel 4 and its collection baseplate 4C or a distribution vessel 5 and its distribution baseplate 5C, which are essentially trapeze-shaped, when viewed in a virtual cutting plane E essentially at right angles to the longitudinal axes L of the tubular elements 2. Here as well the main extension directions 3H1, 3H2 of at least two adjacent flow channels 3X, 3Y enclose an angle γ deviating from 0°.

FIG. 10 shows a collection vessel 4 and its collection baseplate 4C or a distribution vessel 5 and its distribution baseplate 5C, which are essentially circular-segment-shaped when viewed in a virtual cutting plane E essentially at right angles to the longitudinal axes L of the tubular elements 2. It can be recognised that the main extension direction 3H of the flow channel 3 extends at an angle φ deviating from 0° in particular at an angle φ between 30° and 60° to the radial direction 4R of the collection vessel 4 or to the radial direction 5R of the distribution vessel 5. The radial direction 4R, 5R extends from the beginning 3A or end 3E of the flow channel 3.

FIG. 11A shows a collection vessel 4 and its collection base plate 4C or a distribution vessel 5 and its distribution baseplate 50, which are essentially curved, wherein two rectangular end regions are connected to each other via a circular-segment-shaped region when viewed in a virtual cutting plane E essentially at right angles to the longitudinal axes L of the tubular elements 2. The directions indicated by arrows of the second fluid F2 during entry into the flow channel 3 and during exit from the flow channel 3 enclose an angle Ψ deviating from 0°, for example an angle Ψ of approx. 45°. The angles η, ζ, ε between the main extension directions 7H of respectively two adjacent guiding elements 7 of a row RN of tubular elements 2 may be chosen to be of different sizes. Moreover the angles η, ζ, ε in different rows RN of tubular elements 2 may be chosen to be of different sizes. The different angles η, ζ, ε allow the dynamic pressure/the heat transition between the first fluid F1 and the second fluid F2 to be varied.

FIG. 11B also shows a collection vessel 4 and its collection baseplate 4C or a distribution vessel 5 and its distribution baseplate 5C, which are essentially curved, wherein two rectangular end regions are connected to each other via a circular-segment-shaped region when viewed in a virtual cutting plate E essentially at right angles to the longitudinal axes L of tubular elements 2. The directions indicated by arrows of the second fluid F2 on entry into the flow channel 3 and on exit from the flow channel 3 enclose an angle Ψ of approx. 90°. Here again the angles η, ζ, ε between the main extension directions 7H of respectively two adjacent guiding elements 7 of a row RN of tubular elements 2 may be chosen to be of different sizes.

The invention claimed is:

1. A heat exchanger, for heat exchange between a first fluid and a second fluid, having at least a first row of tubular elements and a second row of tubular elements, each for passage of the first fluid, wherein a flow channel for the second fluid is formed between the first and the second row of tubular elements, with a collection vessel at the one ends of the tubular elements and with a distribution vessel at the other ends of the tubular elements, wherein guiding elements for guiding the second fluid along the flow channel extend between the outer sides of adjacent tubular elements of the first and second row of tubular elements, the guiding elements each comprising a plate part the wall thickness of which is less than the maximum cross-sectional dimension of the tubular elements connected thereto, wherein at least one adjustment device is provided for adjusting the relative position of two guiding elements about a pivot axis extending essentially in direction of the longitudinal axes of the tubular elements, wherein the flow channel comprises an input end and an output end, and main extension directions of at least two adjacent flow channels enclose an angle (γ) between each other, the angle (γ) deviating from 0°, wherein a main extension direction of a flow channel is the direction from the input end to the output end of the flow channel.

2. The heat exchanger according to claim 1, wherein holding devices are provided in order to connect adjacent tubular elements of the first or second row of tubular elements with each other via the guiding elements.

3. The heat exchanger according to claim 1, wherein two wing parts protrude from the outer side of each tubular element, wherein two wing parts on adjacent tubular elements of the first or second row of tubular elements together form one guiding element of the guiding elements for the second fluid.

4. The heat exchanger according to claim 3, wherein each wing part comprises a connection element of the holding device, which together form a joint of the adjustment device.

5. The heat exchanger according to claim 4, wherein spiral-shaped bent edges of the wing parts are provided as connection elements.

6. The heat exchanger according to claim 1, wherein the guiding elements each comprise a joint portion of the adjustment device, which joint portion is rotatably arranged about at least one of the tubular elements connected to the guiding element.

7. The heat exchanger according to claim 1, wherein the tubular elements of the first and second row of tubular elements and the guiding elements are arranged relative to each other such that the main extension directions of at least two adjacent guiding elements of the first or second row of tubular elements, in a plane essentially at right angles to the longitudinal axes of the tubular elements, enclose an angle ($\eta$, $\zeta$, $\varepsilon$) deviating from 180°.

8. The heat exchanger according to claim 7, wherein the arrangement of tubular elements of the first or second row of tubular elements and of the at least two adjacent guiding elements enclosing the angle ($\eta$, $\zeta$, $\varepsilon$) deviating from 180°, in the first or second row of tubular elements, repeats at regular intervals.

9. The heat exchanger according to claim 1, wherein the arrangement of tubular elements of the first or second row of tubular elements and of the guiding elements in a plane essentially at right angles to the longitudinal axes of the tubular elements forms an essentially undulating course of the flow channel.

10. The heat exchanger according to claim 9, wherein the plate parts each comprise arched, outer surfaces.

11. The heat exchanger according to claim 1, wherein the arrangement of tubular elements of the first or second row of tubular elements and of the guiding elements in a plane essentially at right angles to the longitudinal axes of the tubular elements forms an essentially zigzag-shaped course of the flow channel.

12. The heat exchanger according to claim 1, wherein the tubular elements of the first and second row of tubular elements are arranged offset from one another in flow direction of the second fluid.

13. The heat exchanger according to claim 1, wherein at least one guiding element comprises at least one plate body protruding therefrom.

14. The heat exchanger according to claim 1, wherein the collection vessel and/or the distribution vessel in a virtual cutting plane essentially at right angles to the longitudinal axes of the tubular elements is essentially rectangular, circular-ring-segment-shaped or circular-ring-shaped.

15. The heat exchanger according to claim 1, wherein the collection vessel and/or the distribution vessel in a virtual cutting plane essentially at right angles to the longitudinal axes of the tubular elements is essentially circular-ring-segment-shaped or circular-ring-shaped, wherein the main extension direction of the flow channel extends at an angle ($\varphi$) deviating from 0° to the radial direction of the collection vessel and/or to the radial direction of the distribution vessel, said radial direction extending from the beginning or the end of the flow channel.

16. The heat exchanger according to claim 15, wherein said angle is between 30° and 60°.

17. The heat exchanger according to claim 1, wherein the heat exchanger is an oil-air-cooler.

18. The heat exchanger according to claim 1, wherein detachable holding devices are provided in order to connect adjacent tubular elements of the first or second row of tubular elements with each other via the guiding elements.

19. The heat exchanger according to claim 1, wherein the plate parts each comprise circular-segment-shaped curved outer surfaces.

20. A heat exchanger, for heat exchange between a first fluid and a second fluid, having at least a first row of tubular elements and a second row of tubular elements, each for passage of the first fluid, wherein a flow channel for the second fluid is formed between the first and the second row of tubular elements, with a collection vessel at the one ends of the tubular elements and with a distribution vessel at the other ends of the tubular elements, wherein guiding elements for guiding the second fluid along the flow channel extend between the outer sides of adjacent tubular elements of the first and second row of tubular elements, the guiding elements each comprising a plate part the wall thickness of which is less than the maximum cross-sectional dimension of the tubular elements connected thereto, wherein at least one adjustment device is provided for adjusting the relative position of two guiding elements about a pivot axis extending essentially in direction of the longitudinal axes of the tubular elements, wherein the collection vessel and/or the distribution vessel in a virtual cutting plane essentially at right angles to the longitudinal axes of the tubular elements is essentially circular-ring-segment-shaped or circular-ring-shaped.

21. A heat exchanger, for heat exchange between a first fluid and a second fluid, having at least a first row of tubular elements and a second row of tubular elements, each for passage of the first fluid, wherein a flow channel for the second fluid is formed between the first and the second row of tubular elements, with a collection vessel at the one ends of the tubular elements and with a distribution vessel at the other ends of the tubular elements, wherein guiding elements for guiding the second fluid along the flow channel extend between the outer sides of adjacent tubular elements of the first and second row of tubular elements, the guiding elements each comprising a plate part the wall thickness of which is less than the maximum cross-sectional dimension of the tubular elements connected thereto, wherein at least one adjustment device is provided for adjusting the relative position of two guiding elements about a pivot axis extending essentially in direction of the longitudinal axes of the tubular elements, wherein holding devices are provided in order to connect adjacent tubular elements of the first or second row of tubular elements with each other via the guiding elements, wherein two wing parts protrude from the outer side of each tubular element, wherein two wing parts on adjacent tubular elements of the first or second row of tubular elements together form one guiding element for the second fluid, wherein each wing part comprises a connection element of the holding device, which together form a joint of the adjustment device, wherein spiral-shaped bent edges of the wing parts are provided as connection elements.

* * * * *